US012171321B2

(12) United States Patent
Fogueteiro

(10) Patent No.: US 12,171,321 B2
(45) Date of Patent: Dec. 24, 2024

(54) COSMETIC-PRODUCT APPLICATOR

(71) Applicant: CHANEL PARFUMS BEAUTE, Neuilly-sur-Seine (FR)

(72) Inventor: Paulo Fogueteiro, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 18/379,978

(22) Filed: Oct. 13, 2023

(65) Prior Publication Data

US 2024/0122334 A1 Apr. 18, 2024

(30) Foreign Application Priority Data

Oct. 14, 2022 (EP) ..... 22306560

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01); *A45D 40/265* (2013.01);
(Continued)

(58) Field of Classification Search
CPC ..... A45D 40/267; A45D 2200/10; A45D 34/046; A45D 34/045; A45D 40/265;
(Continued)

(56) References Cited

U.S. PATENT DOCUMENTS 7,914,221 B2 * 3/2011 Milesi ..... A46B 9/021 401/126
8,070,373 B2 * 12/2011 Kim ..... A45D 40/265 401/129

(Continued)

FOREIGN PATENT DOCUMENTS

EP 1 593 320 A1 11/2005
EP 3 528 660 B1 8/2020

(Continued)

OTHER PUBLICATIONS

Search Report issued in European Patent Application No. 22306560.8, dated Feb. 27, 2023.

(Continued)

*Primary Examiner* — David J Walczak
(74) *Attorney, Agent, or Firm* — GREENBLUM & BERNSTEIN, P.L.C.

(57) ABSTRACT

A cosmetic-product applicator including a gripping element adapted to be gripped by a user, an application tip having a shape the external envelope of which is of revolution, a cylindrical rigid core extending in a longitudinal direction, said core being rigidly secured to the gripping element or formed in a single piece with the gripping element, and a hollow stick mounted so as to be able to rotate freely but translationally fixed on the core, the hollow stick extending longitudinally from the gripping element to the application tip. The application tip is rigidly connected to the hollow stick or formed in a single piece with the hollow stick, and the core extends in the hollow stick over the whole length of the hollow stick measured in the longitudinal direction, with the optional exception of a connection zone between the hollow stick and the application tip.

15 Claims, 3 Drawing Sheets

(52) U.S. Cl.
CPC ..... *A45D 34/041* (2013.01); *A45D 34/045* (2013.01); *A45D 40/261* (2013.01); *A45D 2200/10* (2013.01)

(58) Field of Classification Search
CPC ..... A45D 34/04; A45D 40/26; A45D 34/041; A45D 40/261; A45D 34/043; A45D 40/264
USPC ..... 401/121, 122, 126–128, 130
See application file for complete search history.

(56) References Cited

U.S. PATENT DOCUMENTS

| | | | | |
|---|---|---|---|---|
| 8,944,713 | B2 * | 2/2015 | Koguchi ..... | A45D 40/205 401/32 |
| 2005/0249539 | A1 | 11/2005 | Habatjou | |

FOREIGN PATENT DOCUMENTS

| | | | |
|---|---|---|---|
| FR | 3 013 197 | A1 | 5/2015 |
| WO | 2015/075339 | A1 | 5/2015 |

OTHER PUBLICATIONS

*Note—FR3013197 is discussed in paragraph 0011 of the specification of the instant application.
*Note—EP3528660 is discussed in paragraph 0012 of the specification of the instant application.

* cited by examiner

COSMETIC-PRODUCT APPLICATOR

CROSS-REFERENCE TO RELATED APPLICATION

The present application claims priority under 35 U.S.C. § 119 of European Patent Application No. EP 22306560.8, filed Oct. 14, 2022, the disclosure of which is expressly incorporated by reference herein in its entirety.

The present invention relates to the field of cosmetic-product applicators.

It relates in particular to an applicator adapted to apply a liquid, viscous or pasty cosmetic product to the skin, for example on the contour of the eyes, in particular under the eyes. Generally, in the present document, an application of a cosmetic product of the skin is envisaged, without however limiting the invention to this area of application.

In the present document cosmetic products encompass in particular all products for making up the skin, lips or keratinous appendages. The applicator that is the object of the present invention is also adapted to applying care products, in particular liquid and viscous care formulae, intended for applying to the skin, lips or the keratinous appendages. For simplicity, in the whole of the present document, when reference is made to a cosmetic product, this also includes care products.

In the remainder of the present document, the term "user" obviously designates a user of either sex.

Cosmetic products must be deposited on the skin homogeneously, in a fine even layer. Ideally, the applicator must also allow a light massage of the area of application of the cosmetic product. A sensation of coolness during application may also be sought.

Various applicators have been envisaged for this.

The most frequent applicators that are adapted to apply cosmetic products are thus applicators of the "pressed tube" type, applicators of the "stick with applicator tip" type, and rotary-ball applicators, often designated by the English expression "roll-on".

Applicators of the "pressed tube" type include a flexible tube containing the product to be applied. The tube must be pressed to cause the product to emerge, via an orifice located on a relatively flat and generally metallic area, in order to provide a sensation of coolness during application. The quantity of product delivered with this type of applicator is imprecise since it depends on the force applied to the tube. Furthermore, spreading the product by means of the applicator surface is done by rubbing on the skin, which does not make it possible to deposit an even film of product. Rubbing during application may also be rough or even irritating for the skin.

Applicators of the "stick with applicator tip" type include a metal stick with a rounded tip. The stick and its tip must be immersed in the cosmetic product for the tip to be covered with the product. The product is applied by rubbing the tip on the skin of the user, or by depositing spots of product by repeated contacts of the applicator on the skin. Just like an applicator of the pressed-tube type, this does not allow even application of the product. Rubbing during application may also be rough or even irritating for the skin. Furthermore, product tends to be lodged between the stick and the tip and forms a mass that is not applied.

Finally, "roll-on" applicators generally include a flexible tube and a tip with a rotatably mounted ball that is loaded with product on its surface internal to the tip when the tube is pressed. The surface of the ball loaded with product is next turned towards the outside of the tip, rolling on the skin of the user, to enable the product to be applied. This type of applicator does not allow precise apportioning of the product applied, the tube having to be pressed to load the ball. The quality of the application depends on the orientation of the applicator, the tip having to be oriented downwards to allow good application. Furthermore, the risks of fouling of this type of applicator are high: cosmetic product can clog the passage between the tube and the ball and thus prevent the latter from rolling freely, or even prevent the product emerging from the tube.

The document FR3013197 presents an applicator the tip of which has a shape of revolution and striations. When the product is applied, the applicator can be moved in contact with the skin by making it slide over it with optionally a rotation movement of the application member on itself about an axis parallel to the longitudinal axis of the stick and/or perpendicular to the longitudinal axis. It is therefore for the user to provide a suitable application movement, in accordance with an action that is not easy to perform, which does not guarantee even application of the product.

The document EP3528660 discloses an applicator for a cosmetic product that includes a gripping member extending along a longitudinal axis, a stick holder disposed in the gripping member, a stick secured to the stick holder and a member for applying cosmetic product carried by the stick, the stick holder being mounted so as to be able to move in rotation about the longitudinal axis with respect to the gripping element. Nevertheless, this applicator has certain drawbacks. Firstly, the product is liable to pass between the stick and the gripping member, which may interfere with the rotation of the stick and cause a loss of product. Furthermore, the configuration of the applicator makes it unsuitable for allowing massage during application, since a transverse force on the tip (the application member) may bend the stick and easily damage the rotational connection of the stick holder with respect to the application member.

The present invention aims to propose an applicator for cosmetic products, including care products, liquid, viscous or pasty, allowing even and continuous application of a precise dose of product on an area of application having a defined surface area, while allowing massage of the entire application area. Such an application must preferentially be achievable in a simple and ergonomic manner, with an action that is obvious for the user.

For this purpose, the invention relates to a cosmetic-product applicator including a gripping element adapted to be gripped by a user and an application tip having a shape the external envelope of which is of revolution. The applicator also includes a cylindrical rigid core extending in a longitudinal direction, said core being rigidly secured to the gripping element or formed in a single piece with the gripping element, and a hollow stick mounted so as to be able to rotate freely but translationally fixed on the core, the hollow stick extending longitudinally from the gripping element to the application tip. The application tip is rigidly connected to the hollow stick or formed in a single piece with the hollow stick. The core extends in the hollow stick over the whole length of the hollow stick measured in the longitudinal direction, with the optional exception of a connection zone between the hollow stick and the application tip.

The invention thus proposes a cosmetic-product applicator wherein the application tip is able to rotate with respect to the gripping element of the applicator, in order to allow easy and even application of the cosmetic product. By virtue of the configuration of the applicator that is the object of the present invention, applying a tangential force to the application tip, allowing massage of the application area, does not cause significant deformation of the applicator and in particular significant bending of the core and of the hollow stick. Furthermore, the rotation mechanism, using a core that extends over the whole or almost the whole of the length of the hollow stick mounted rotatably on the core, allows application of such a tangential massage force on the tip without affecting the rotation mechanism. Finally, the risk of fouling of the rotation mechanism by cosmetic product is eliminated.

The core may be metallic. Any other suitable rigid material can alternatively be used. The concept of rigid should be understood as a resistance to bending sufficient to withstand a radial force exerted on the application tip when the cosmetic product is applied, without bending too much, which would impair the free rotation of the tip and of the stick. The application tip may be metallic or made from ceramic. The hollow stick may be metallic. The hollow stick and/or the application tip may be made from plastics material covered, on an external surface, with a metal cladding. In this case, the hollow stick may include a body made from plastics material, the body being covered with a metal sleeve.

Various combinations of material can thus be envisaged. The use of a metal or ceramic application tip is preferred. A metal application tip offers a sensation of coolness to the user during application. Furthermore, an applicator the application tip and hollow rod of which have an identical appearance, preferably metallic, for example chromium plated, is perceived to be a product of good quality.

The hollow rod may include a perforated internal surface so as to limit the areas of contact between said hollow rod and the core.

The applicator may include a first rotational-guidance member and a second rotational-guidance member, the first rotational-guidance member being interposed between the core and the hollow stick at a first end of the hollow stick, and the second rotational-guidance member being interposed between the core and the hollow stick at a second end of the hollow stick.

The first rotational-guidance member and the second rotational-guidance member being able to be bearings made from plastics material, from ceramic or from metal such as copper or copper alloy.

The first rotational-guidance member and the second rotational-guidance member may be rolling bearings.

The applicator may include a single rotational-guidance member interposed between the core and the hollow stick. The rotational-guidance member advantageously extends over the entire length, or over at least a majority of the length, of the hollow stick.

The rotational-guidance members make it possible to limit the contact surface between the core and the hollow stick, which makes it possible to limit friction liable to restrict the rotation of the hollow stick and of the application tip. They also make it possible to guarantee the longitudinal position of the areas of contact between the core and the hollow stick, which improves the ability of the mechanism to operate correctly despite the tangential force applied to the application tip. Finally, they make it possible to limit noise during the relative rotation between the core and the hollow stick, in particular when the core and hollow stick are both metal.

The core may include a proximal end of the gripping element and an opposite distal end, the hollow stick and the application tip being rotationally locked with regard to the core at said distal end of the core.

This optimises the translational locking of the hollow stick, the latter being interposed between the distal end of the core and the gripping end of the applicator.

The application tip may include on its surface relief patterns, preferentially helicoidal.

The relief patterns may be of any type of texture or any projecting pattern. The helicoidal patterns may in particular be ribs or flutes. They afford better retention of the product on the surface of the application tip, and cause a gradual attachment of the applicator on the skin of the user, as the application progresses. These patterns thus guide and "accompany" the action of the user during the application of the cosmetic product.

The gripping elements may form a cap adapted to close the neck of a corresponding bottle. The gripping element may include an internal structure and an external structure that covers said internal structure, the internal structure (23) including a longitudinal channel in which the core is inserted and secured.

The applicator that is the object of the present invention is thus particularly adapted to be used with a bottle for which it serves as a cap.

The invention also relates to an assembly including a bottle and an applicator as defined above, wherein the bottle contains the cosmetic product, the bottle including a neck adapted to be closed by the cap formed by the gripping element, so that, when the bottle is closed off by said cap, the application tip is in contact with the cosmetic product.

The bottle may include a squeegee, the squeegee providing wiping of the application tip as it passes, so that a defined quantity of product is carried by the application tip after the applicator is extracted from the bottle.

This makes it possible to load the application tip with a precise quantity of product, optimum and even, that is to be applied to a given area of the user (for example the underside of an eye).

In the appended drawings, given by way of non-limiting examples:

Figure 1:
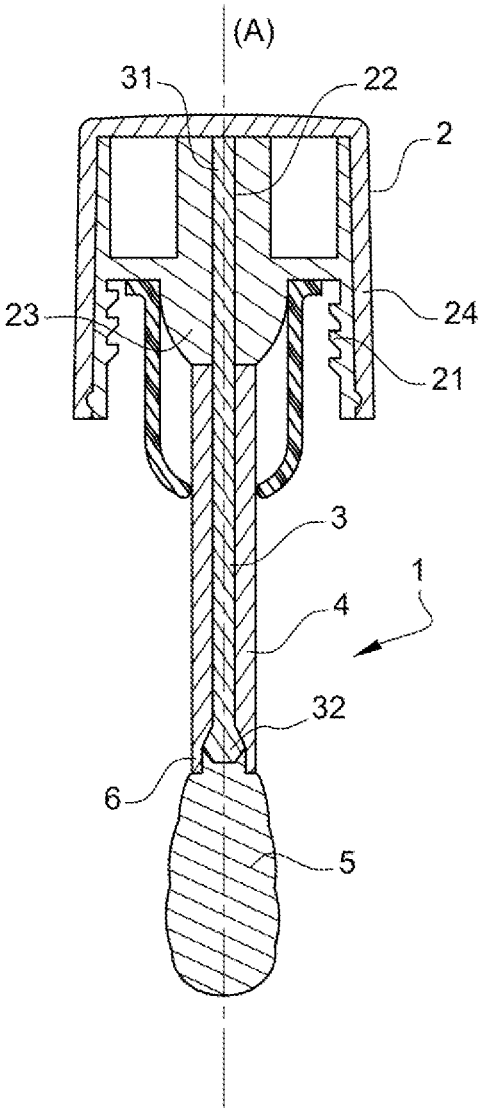
FIG. 1 is a schematic view in cross section of a cosmetic-product applicator in accordance with an embodiment of the invention.

FIG. 1 shows a cosmetic-product applicator 1 in accordance with an embodiment of the invention. This applicator 1 includes a gripping element 2 here formed by a cap adapted to be screwed onto a cosmetic-product bottle including an adapted neck. For this purpose, the cap may be provided with a thread 21. According to other embodiments, the cap could be adapted to be attached to the bottle by snapping on.

The gripping element 2 is adapted to be gripped by hand by a user wishing to use the applicator.

The applicator extends in a general extension direction, around the axis A. The general extension direction of the applicator is said to be longitudinal.

The applicator includes a core 3 which extends longitudinally along the axis A. The core 3 is a circular cylinder. It may be metallic or made from plastics material. According to a preferred embodiment, the core 3 is metallic so as to have great rigidity. The core 3 is therefore overall in the form of an elongate cylindrical stick, of great length compared with its diameter.

The core 3 is straight and includes a proximal end 31 with respect to the gripping element 2 and a distal end 32 opposite to the proximal end 31. The core 3 is rigidly secured to the gripping element 2, at the proximal end. In particular, the proximal end and a portion of the core 3 are secured in a longitudinal channel 22 of the gripping element 2. This securing can be achieved in various ways, by force-fitting, by adhesive bonding, brazing, by screwing, and/or by means of a securing element (not shown in FIG. 1, but visible in FIG. 3).

Alternatively, the core 3 may be formed monobloc, in a single piece, with all or part of the gripping element.

In the example shown, the gripping element 2 is formed in two parts, namely an internal structure 23 and an external structure 24. The external structure 24 corresponds to the visible part of the gripping element, which can be gripped by the user and can have an aesthetic role. The internal structure 23 forms, in the example shown, the thread 21 and includes the longitudinal channel 22 in which the core 3 is secured. Alternatively, the internal structure 23 and the external structure 24 may be formed in a single piece.

The applicator 1 has the particularity of including a hollow stick 4. The hollow stick 4 is longitudinal and straight. It is mounted so as to be able to rotate freely on the core 3. It is on the other hand fixed with respect to translation along the core 3.

An application tip 5 is secured, rigidly, without any degree of freedom, at one end of the hollow stick 4. This securing can be implemented by force-fitting, adhesive bonding, brazing, or any other suitable securing solution. The application tip 5 may alternatively be formed monobloc, in a single piece, with the hollow stick 4.

The application tip 5 is thus free to rotate, conjointly with the hollow stick 4, about the core 3.

The application tip 5 is advantageously metal or made from ceramic. This provides a sensation of coolness during contact of the application tip 5 on the skin of the user. A decongestioning effect on the skin can also be obtained. This also procures an aesthetic appearance for the tip. A metal or ceramic tip is generally perceived as an object of great quality by the user.

Alternatively, a tip made from plastics material, covered by a metal or ceramic cladding, may be used.

The hollow stick 4 may also be metallic. It may alternatively be formed from plastics material covered with a preferentially metal cladding. The metal cladding may then be formed by a metal deposition (for example a deposition under vacuum, for example a physical or chemical vapour deposition) or be formed by a metal sleeve that covers a plastic body of the hollow stick 4.

The tip and the hollow stick advantageously have the same surface appears, for example metallic and shiny, such as a chromium-plated appearance.

The tip has a general shape of revolution, i.e. the external envelope of its three-dimensional shape is of revolution, in order to enable the tip to roll on the skin of the user when the cosmetic product is being applied, as described below. The external envelope of the shape of the application tip therefore corresponds to the three-dimensional geometric shape that approximates the shape of the tip, without taking account of any local surface deformations or patterns. It is the general shape of the application tip as perceived spontaneously. The tip may nevertheless have reliefs on its surface, for example striations, furrows, ribs or flutes. The reliefs on the surface of the tip can have the function of improving the retention of the product on the tip, but also improving the rolling of the tip on the skin. The striations, furrows, ribs or flutes are thus advantageously longitudinal or helicoidal, around the axis A. A helicoidal form is preferred, since it causes attachment on the skin that is gradual, without jerks, as the application progresses. Likewise, the surface of the tip may have a texture which, increasing the roughness of the surface, improves the retention of the cosmetic product on the tip.

The translational locking of the hollow stick 4 with respect to the core 3 is implemented, in one direction, at the distal end 32 of the core 3. This locking can be achieved by means of a splaying of the distal end of the core 3, or by a part attached at said distal end of the core. This locking prevents the hollow stick 4 from being separated from the gripping element 2. The tip and/or the gripping element prevents translation in the opposite direction.

The core 3 extends in the hollow stick 4 over the whole of its length, with the optional exception of the connection zone 6 between the hollow stick 4 and the application tip 5. In other words, the core 3 extends as far as the application tip 5, to within a functional clearance, where applicable.

For applying a cosmetic product, the user grips the applicator by the gripping element 2 and, the tip having previously been loaded with cosmetic product, the user rolls it over their skin. The application is therefore implemented, intuitively, in a substantially transverse direction, i.e. perpendicular to the longitudinal direction of the axis A of the applicator.

The rolling on the skin, combined with the force applied transversely to the applicator, provides a light massage of the area of application of the product. The force applied transversely also participates in the application of a thin even film of cosmetic product.

Applying a relatively high transverse force is made possible, despite the elongate shape of the applicator, for several reasons. First of all, the structure of the applicator, with a rigid longitudinal core that extends as far as the application tip, and a hollow stick mounted on the longitudinal core, procures great rigidity for the applicator. Furthermore, the fact that the core extends over the entire length of the hollow stick, or almost so, makes it possible to rotationally guide the hollow stick and the application tip at distant longitudinal points: the rotational guidance can in particular be implemented at both ends of the hollow stick. This limits the risk of locking of the rotation mechanism because of the transverse force applied at the application tip 5.

Rolling the application tip on the skin makes it possible to deposit all the product carried on the tip. The quantity of product carried by the tip can be precisely calibrated by the configuration of the tip.

Figure 2:
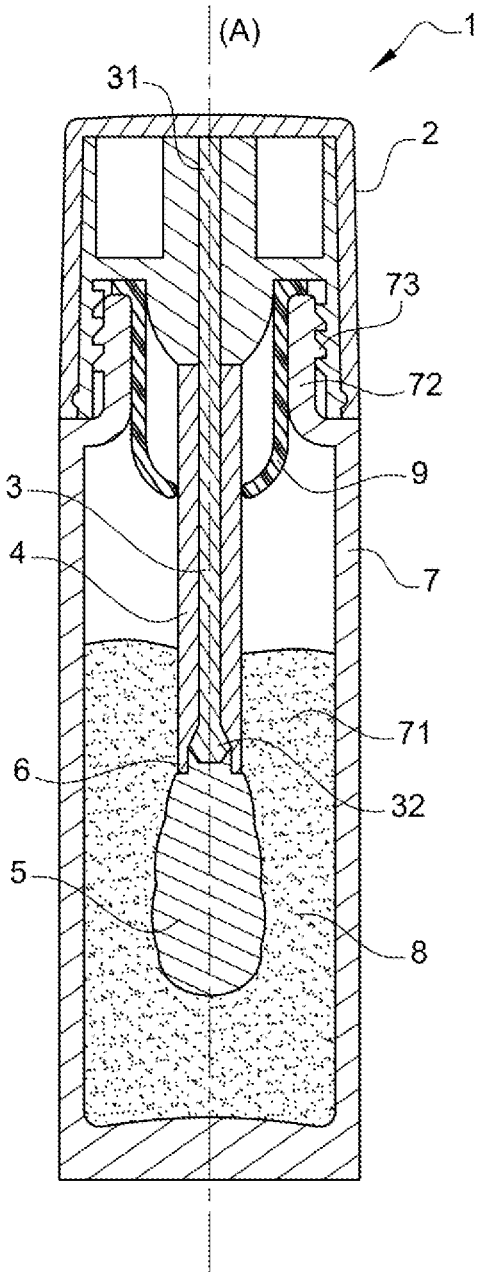
FIG. 2 is a schematic view in cross section of an assembly including a cosmetic-product bottle and a cosmetic-product applicator in accordance with an embodiment of the invention.

FIG. 2 shows an assembly including a cosmetic-product bottle 7 and the applicator 1 of FIG. 1. The bottle 7 forms an internal volume 71 containing a cosmetic product 8, liquid, viscous or pasty, for example semi-liquid. The bottle includes a neck 72 that is threaded. In the example shown, the threading is implemented by attaching a threaded ring 73 to the neck of the bottle 2.

When the applicator 1 is screwed onto the bottle 7 (the gripping element 2 forming an adapted cap), the application tip 5 is in contact with the cosmetic product 8. For example, the application tip 5 is immersed in the cosmetic product 8. The application tip 5 is thus loaded with cosmetic product, at its surface and/or in one or more cavities formed by the application tip 5.

The bottle 7 includes a squeegee 9. The squeegee 9 is a flexible device located in proximity to the neck 72 or in the latter. The squeegee 9 forms a calibrated passage for the insertion and removal of the application tip 5. The squeegee 9 firstly makes it possible to eliminate the excess cosmetic product from the application tip 5 when it is removed from the bottle 7. Thus, whenever it is extracted from the bottle 7, the application tip 5 is loaded with a precise quantity of cosmetic product. According to the configuration of the application tip 5 (in particular the area of its external surface, the volumes and cavities created by the patterns that it carries, etc) and according to the configuration of the tip and the physicochemical properties of the cosmetic product 8, the application tip 5 is loaded, after passing through the squeegee 9, with a predetermined quantity of cosmetic product that is precise, even and optimum, for application on a given area of the body of the user. For example, the applicator can be loaded with a predetermined dose of cosmetic product that is precise, even and optimum for applying under or around an eye.

Squeegee is spoken of since this type of device is generally used with a flexible application tip that it wipes. In the context of the present invention, the application tip is preferably rigid and non-deformable during normal use.

The squeegee 9 may be of the so-called "turning-over squeegee" type. Such a squeegee 9 has a frustoconical shape and tends to turn over when the application tip 5 passes. A turning-over squeegee makes it possible to drain and wipe elements having two different diameters. In this case, the squeegee 9 wipes the external surface of the hollow stick 4 on the one hand and the application tip 5 on the other hand. Thus the stick of the applicator is always perfectly clean, without any residual cosmetic product on its surface.

The squeegee can also advantageously include an orifice for balancing the pressure between the internal volume 71 of the bottle 7 and the exterior of said bottle (i.e. the atmosphere, or ambient air). This avoids creating mechanical resistance when the applicator 1 is extracted from the bottle 7, or when they applicator 1 is inserted in the bottle 7, and avoids generating a Venturi effect when the applicator 1 is extracted from the bottle 7.

It is moreover remarkable that the rotation mechanism of the tip and stick is particularly well protected against any clogging by cosmetic product. This is because the connection zone 6 between the hollow stick 4 and the application tip 5 is advantageously perfectly impervious to the cosmetic product. The only possible infiltration zone is then located at the end of the hollow stick located in the immediate vicinity of the gripping element. A seal can be provided in this zone, although it is improbable for this zone to be affected by product, because of its distance from the application tip 5, and by virtue of the squeegee 9 that, where applicable, cleans the hollow stick 4.

Figure 3:
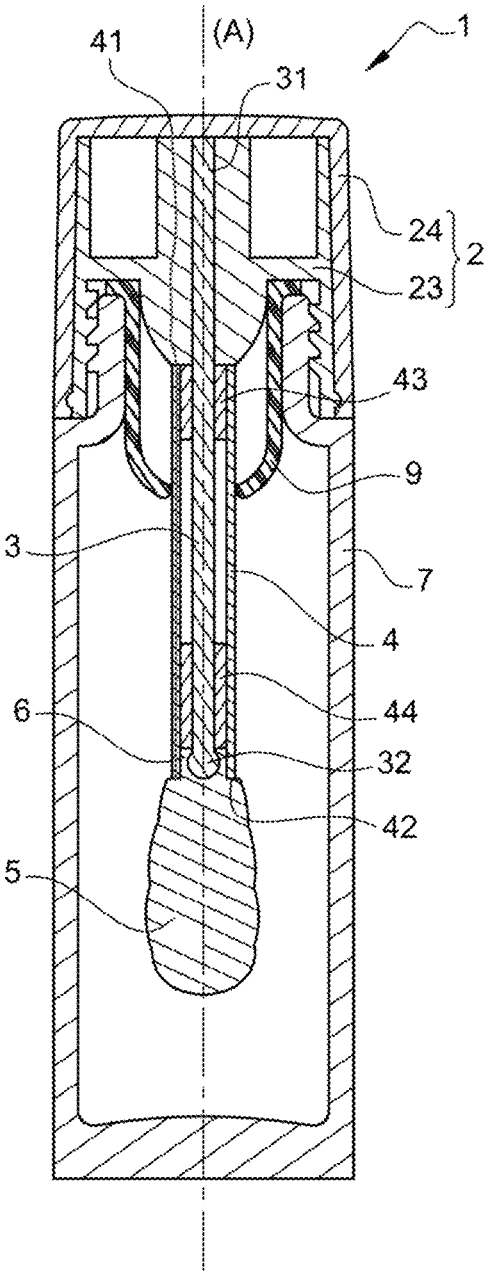
FIG. 3 is a schematic view, in cross section, of an assembly including a cosmetic-product bottle and a cosmetic-product applicator in accordance with an embodiment of the invention.

FIG. 3 shows an assembly including a cosmetic-product bottle 7 and an applicator 1 in accordance with an embodiment of the invention.

There are thus found, shown on FIG. 3, apart from the bottle 7, the gripping element 2 including an internal structure 23 and an external structure 24, the hollow stick 4, the core 3 and the tip 5.

The core 3 is secured by a tight fit in the internal structure 23 of the gripping element 2. Other alternative or complementary securing methods can be used. For example, a securing element can for example be screwed or crimped on the core 3, at the proximal end 31 thereof, in order to secure the core 3 to the gripping element 2.

The embodiment of the invention shown in FIG. 3 is moreover remarkable in that the applicator also includes a first rotational-guidance member 43 and a second rotational-guidance member 44. The first rotational-guidance member 43 is interposed between the core 3 and the hollow stick 4 at a first end 41 of the hollow stick 4. The second rotational-guidance member 44 is interposed between the core 3 and the hollow stick 4 at a second end 42 of the hollow stick 4.

Each of the first rotational-guidance member 43 and second rotational-guidance member 44 may be formed by a main bearing or a rolling bearing. One of the first rotational-guidance member 43 and second rotational-guidance member 44 may be formed by a main bearing while the other is a rolling bearing.

As an alternative, a single rotational-guidance member may be used. In this case, the guidance member is sufficiently long to distribute the transverse forces exerted on the application tip over a sufficient length of the hollow stick 4. For example, the guidance member may extend over the entire length, or almost all the length, of the hollow stick 4.

However, in the absence of a rotational-guidance member, the hollow stick 4 may have a perforated interior surface, i.e. having hollowed parts. This limits the areas of contact between the hollow rod 4 and the core 3. Friction is thus reduced, rotation is freer, and any noises related to the rotation are limited.

In particular, a bearing made from plastics material providing low friction can be used. The plastics material used may, non-exhaustively, be polytetrafluoroethylene (PTFE), a plastics material with PTFE filler, polyetheretherketone (PEEK), phenylene polysulfide (PSS), nylon, acetal and polyester.

The rotational-guidance members limit the contact surface between the core 3 and the hollow stick 4, which facilitates the rotation of the latter.

The rotational-guidance members also guarantee the longitudinal position of the contact areas between the core 3 and the hollow stick 4.

Finally, the rotational-guidance members limit the noise during the relative rotation between the core 3 and the hollow stick 4. This is because a slight noise may occur when the contact surfaces are large and/or when the core 3 and the hollow stick 4 are both metal, so that a "metal on metal" rubbing occurs during the rotation of the hollow stick 4.

Moreover, although the applicator of FIG. 1 and that of FIG. 3 are presented as assemblies of various elements formed independently of each other, it is alternatively possible to conjointly produce several of these elements by additive manufacturing. This makes it possible to limit the assemblies to be produced, and to directly obtain complex assemblies of small dimensions. In particular, the core, the hollow stick and the application tip may be formed together by additive manufacturing. In this way a subassembly including the hollow stick and the application tip are obtained directly, free to rotate about the core, but fixed with respect to translation thereon. The gripping element may also be obtained, in whole or in part (for example only the internal structure), conjointly with the aforementioned elements.

Numerous shapes of application tip can be envisaged in the context of the invention. FIGS. 1 to 3 show an applicator 1 have a tip in a so-called bud shape, i.e. an elongate shape of revolution gradually splaying and terminating in a rounded end.

Figure 4:
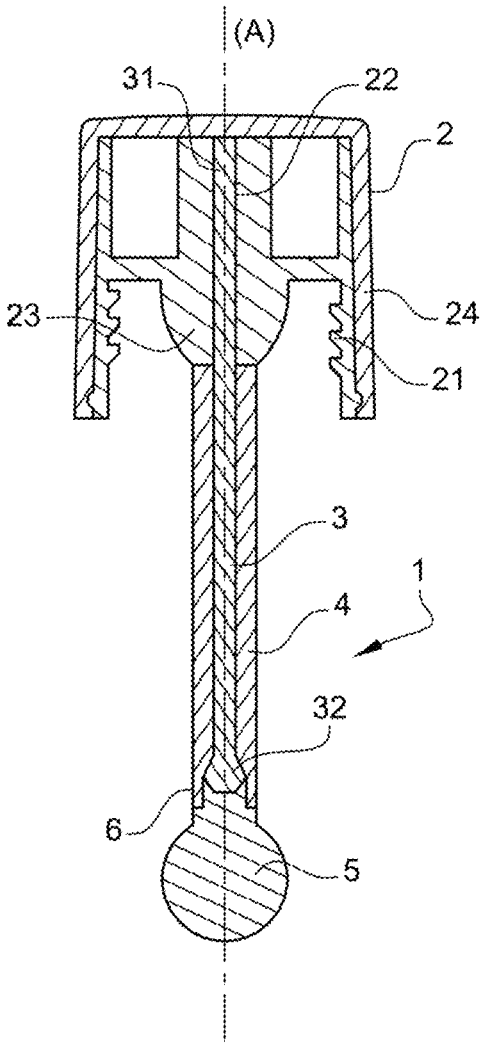
FIG. 4 is a schematic view in cross section of a cosmetic-product applicator in accordance with a second embodiment of the invention.
Figure 5:
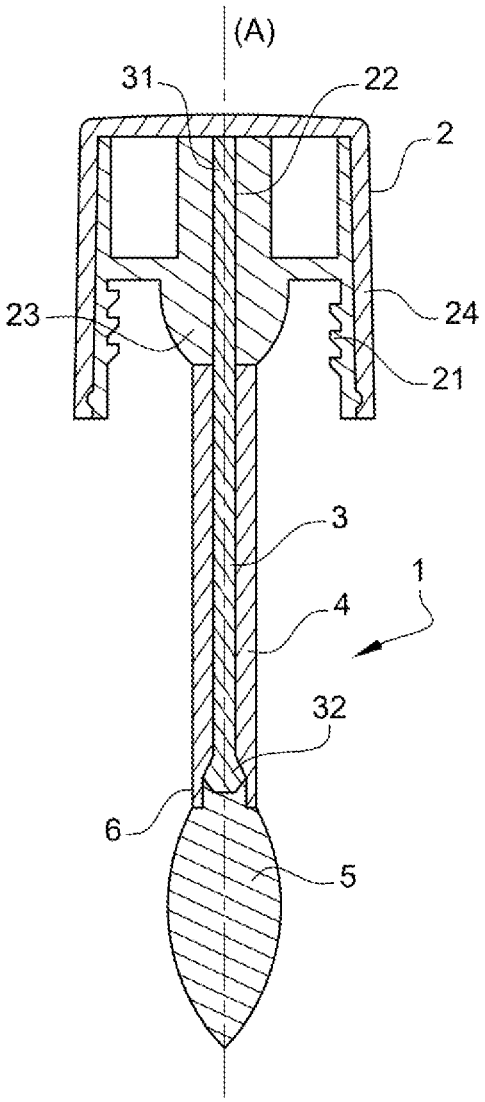
FIG. 5 is a schematic view in cross section of a cosmetic-product applicator in accordance with a third embodiment of the invention.

FIG. 4 and FIG. 5 present alternative embodiments of applicators in accordance with the present invention, wherein the application tips 5 have other shapes.

In FIG. 4, the application tip 5 has a roughly spherical shape.

In FIG. 5, the application tip 5 is roughly in the shape of a rugby ball.

The applicator for a cosmetic product, including a care product, thus developed according to the invention allows even application, in a thin even film, of a precise quantity of product throughout the rotation on the skin of the user. The rotary character of the applicator improves the evenness of application, avoids the formation of a mass of product, and allows even and gentle application without requiring complex movement on the part of the user. The action to be performed for applying the product is thus simple and logical. Because of its configuration, the cosmetic-product applicator allows the application of a transverse force allowing a massage of the application area, without the applicator being significantly deformed and without the rotation mechanism being able to be affected or damaged by this transverse force. When the application tip includes reliefs, in particular helicoidal, rolling the tip over the skin can cause alternating pressures on the skin (as "wavelets") favouring blood microcirculation in the application area. The effect is thus similar to that of a tapping action that is recommended when applying a cosmetic product to the eye area. According to some embodiments, the applicator provides a sensation of coolness and can provide a decongestioning effect for the skin. Finally, the risks of fouling of the applicator by the cosmetic products are limited.

The invention claimed is:

1. A cosmetic product applicator comprising:

a gripper configured to be gripped by a user;

an application tip having a shape an external envelope of which is of revolution;

a cylindrical rigid core extending in a longitudinal direction, said core being rigidly secured to the gripper or formed in a single piece with the gripper;

a hollow stick extending longitudinally from the gripper to the application tip, the hollow stick being mounted so as to be able to rotate freely but being translationally fixed on the core, so that the application tip is free to rotate, conjointly with the hollow stick, about the core;

the application tip being rigidly connected to the hollow stick or formed in a single piece with the hollow stick; and the core extending in the hollow stick over an entire length of the hollow stick measured in the longitudinal direction, with the optional exception of a connection zone between the hollow stick and the application tip.

2. Cosmetic-product applicator according to claim 1, wherein:

the core is metallic.

3. Cosmetic-product applicator according to claim 1, wherein:

the application tip is metallic or made from ceramic.

4. Cosmetic-product applicator according to claim 1, wherein:

the hollow stick is metallic.

5. Cosmetic-product applicator according to claim 1, wherein:

the hollow stick and/or the application tip is made from plastics material covered, over an external surface, with a metal cladding.

6. Cosmetic-product applicator according to claim 5, wherein:

the hollow stick includes a body made from plastics material, the body being covered with a metal sleeve.

7. Cosmetic-product applicator according to claim 1, wherein:

the hollow stick includes a perforated internal surface so as to limit the areas of contact between said hollow stick and the core.

8. Cosmetic-product applicator according to claim 1, wherein:

the core includes a proximal end of the gripper and an opposite distal end;

the hollow stick and the application tip being rotationally locked with regard to the core at said distal end of the core.

9. Cosmetic-product applicator according to claim 1, wherein:

the application tip includes on its surface relief patterns.

10. Cosmetic-product applicator according to claim 9, wherein:

the application tip includes on its surface helicoidal relief patterns.

11. Cosmetic-product applicator according to claim 1, wherein:

the application tip includes on its surface helicoidal relief patterns.

12. Cosmetic-product applicator according to claim 1, wherein:

the gripper forms a cap configured to close a neck of a corresponding bottle.

13. Cosmetic-product applicator according to claim 12, wherein:

the gripper includes an internal structure and an external structure that covers said internal structure, the internal structure including a longitudinal channel in which the core is inserted and secured.

14. Assembly including a bottle and an applicator according to claim 12, wherein:

the bottle contains cosmetic product, the bottle including a neck adapted to be closed by the cap formed by the gripper, so that, when the bottle is closed off by said cap, the application tip is in contact with the cosmetic product.

15. Assembly according to claim 14, wherein:

the bottle includes a squeegee, the squeegee providing wiping of the application tip as it passes, so that a defined quantity of product is carried by the application tip after the applicator is extracted from the bottle.

* * * * *